United States Patent [19]

Ney

[11] Patent Number: 4,813,075

[45] Date of Patent: Mar. 14, 1989

[54] METHOD FOR DETERMINING THE VARIATION WITH TIME OF A SPEECH PARAMETER AND ARRANGEMENT FOR CARRYIN OUT THE METHOD

[75] Inventor: Hermann Ney, Hamburg, Fed. Rep. of Germany

[73] Assignee: U.S. Philips Corporation, New York, N.Y.

[21] Appl. No.: 125,101

[22] Filed: Nov. 24, 1987

[30] Foreign Application Priority Data

Nov. 26, 1986 [DE] Fed. Rep. of Germany ..... 3640355

[51] Int. Cl.[4] ..... G10L 5/00

[52] U.S. Cl. ..... 381/43; 364/402; 381/47

[58] Field of Search ..... 381/29–47; 364/402

[56] References Cited

U.S. PATENT DOCUMENTS 4,555,796 11/1985 Sakoe ..... 381/43

4,751,737 6/1988 Gerson ..... 381/43

FOREIGN PATENT DOCUMENTS 0079578 10/1986 European Pat. Off.

*Primary Examiner*—Emanuel S. Kemeny

*Attorney, Agent, or Firm*—Thomas A. Briody; Jack E. Haken; Anne E. Barschall

[57] ABSTRACT

In a speech or speaker recognition system, a segment or sequence of speech parameter values are smoothed to a most probable sequency by Dynamic Programming. The method for determining the variation with time of a speech parameter is based on a speech signal which is subdivided into successive segments and an individual value exists in each segment and for each value of the parameter within a limited range of values. For the example of the fundamental voice frequency, a value has been generated in each speech segment with the aid of the AMDF (Average Magnitude Difference Function). The required variation now links a sequency of horizontally, vertically or diagonally directly adjacent speech parameter values to one another in such a manner that the sum of the associated individual values represents a minimum. In this arrangement, this sum is slightly magnified in diagonal or vertical sections since a horizontal variation is most probable. This magnification is controlled by certain fixed values which influence the smoothness of the variation.

4 Claims, 3 Drawing Sheets

Figure 1:
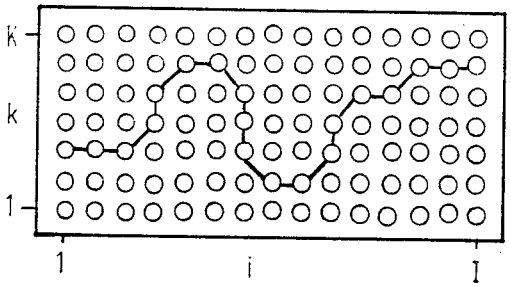

METHOD FOR DETERMINING THE VARIATION WITH TIME OF A SPEECH PARAMETER AND ARRANGEMENT FOR CARRYIN OUT THE METHOD

The invention relates to a method for determining the variation with time of a speech parameter of a speech signal, in which an individual value exists at discrete points in time for each value of a predetermined value range of the speech parameter and the variation with time represents the sequence of adjacent, including diagonally adjacent, speech signal parameter values the individual values of which are at least close to the extreme values of the individual values for the individual points in time, the sum of the individual values of this sequence forming an extreme value sum compared with other sequences.

A speech parameter can be, for example, the fundamental frequency or a formant of a speech signal to be investigated. Other speech parameters are, for example, LPC (linear predictive code) coefficients.

The individual values, for example of the fundamental speech frequency, can be determined with the aid of AMDF (Average Magnitude Difference Function). For this purpose, the speech signal is sampled, for example at a sampling rate of 10 kHz, and a particular number of successive samples which, therefore, overall represent a speech signal section, are shifted step by step compared with the speech signal by a number of sampling points and the difference of the samples of the unshifted and of the shifted signal are summed together for the individual shifting steps. The shifting which results in the smallest sum value generally designates the period of the fundamental speech frequency. However, these values are not always quite unambiguous, small sum values can occur in the case of periods of harmonics or formants and there are other influences which falsify the correct determination of the fundamental speech frequency. However, with different shifts, the AMDF produces for each of the successive speech sections which are shifted with respect to the speech signal, in each case a value which specifies a certain probability or, more accurately, improbability for the shifting concerned specifying the fundamental period of the speech signal.

It is necessary for many investigations, for example for speech recognition or also speaker recognition, to obtain a coherent variation of one or several speech parameters such as the fundamental speech frequency with time in order to be able to compare this variation with sample variations. The AMDF values determined must therefore be freed of freak values and otherwise smoothed. Smoothing by a, for example, linear filter, however, frequently results in deviations or falsifications of an optimum or most probable variation which are too large. Such a variation is best characterized by the sequence of speech parameter values the individual values of which are at least close to the minimum at the point in time concerned when the sum of these individual values overall forms a minimum compared with other sequences.

The invention therefore has the object of specifying a method of the type initially mentioned which approximates this most probable variation of a speech parameter as well as possible.

According to the invention, this object is achieved by the fact that, referred to the minimum as extreme value of the individual values and as extreme value sum at each point in time i, a first direction value D'(k,i) is formed in a first pass successively for all speech parameter values k following one another in the one direction, as the sum of the individual value concerned and the minimum of the following values $$D(k,i-1)$$
$$D(l,i-1)+a(d(k,i)+A)$$
$$D'(l,i)+b(d(k,i)+A)$$

as well as a pointing value h'(k,i) pointing to the individual value supplying the minimum and is stored, where D(k,i−1) and D(l,i−1) is a sum value generated and stored at the respectively preceding point in time i−1 and the same speech parameter value k or the preceding speech parameter value 1, respectively, D(l,i) is the direction value formed at the immediately preceding speech parameter value and a, b, A are predetermined fixed quantities, that thereafter a second direction value D''(k,i) with a pointing value h''(k,i) is formed, in the manner corresponding to the first direction value, in a second pass for the same point in time i for all speech parameter values k following one another in the other direction, that for each speech parameter value k the minimum of the two direction values D',D'' and the pointing value h',h'' belonging to this direction value is stored as in each case new sum value D or as total pointing value H, respectively, and that the immediately preceding speech parameter value is determined, at the latest at the end of the speech signal, from the total pointing value H (k,I) which belongs to the speech parameter value k with the extreme value sum at the last point in time I and the associated total pointing value is read out and so forth, the sequence of speech parameter values produced during this process being output and stored.

Due to the method according to the invention, therefore, sequences of speech parameter values are determined by means of the so-called dynamic programming which result in various values of the sums of the individual values at the end of the speech signal and the sequence which results in the minimum of the sum value at the end of the speech signal is considered to be the most probable sequence. This sequence can then be traced back by storing the total pointing values for each speech parameter at each point in time.

When the sum values are formed for the individual sequences of speech parameter values, certain predetermined fixed quantities are used of which the quantities a and b predominantly influence the smoothness of the variation in that a variation in the diagonal direction and in the vertical direction is made more difficult, and, for this purpose, these two quantities a and b suitably have values of between 0.5 and 2.0. The quantity A approximately corresponds to the value which the AMDF exhibits in unvoiced speech sections and pause sections and forces an essentially horizontal variation of the speech parameter in these sections.

The at least two passes for the separate determination of the two direction values, that is to say once in the upward direction and once in the downward direction or conversely, are required since, for each direction value for a possible variation in the vertical direction, the direction value immediately preceding in the direction concerned must also be taken into consideration and thus must be previously determined.

The various values formed in the method according to the invention must be stored since they are subsequently further used. However, an accurate check of the sequence of the method according to the invention shows that various values are only needed during a relatively short time section. A development of the invention is therefore characterized by the fact that the direction values D',D'' and the pointing values h',h'' and the new sum values are stored for one point in time only in each case and thereafter are overwritten again. Thus, only the total pointing values must be stored for all speech parameters of all points in time since only these are required for tracing back the sequence finally determined as being optimal whereas the other values are in each case stored for only one point in time since they are no longer needed thereafter. In particular, the sum value of all speech parameters is only needed for the preceding point in time during the determination whereas the direction values determined are only needed for the instantaneous point in time. A great amount of storage space can be saved in this manner.

The determination of the new sum value in each case from the minimum of the two direction values can occur in another pass after both direction values for each speech parameter of one point in time have been determined. However, it is also possible in many cases to determine the new sum value in each case directly after the determination of the second direction value for one speech parameter in each case and thus to overwrite the old sum value since this is no longer needed in that case. A further development of the invention is therefore characterized by the fact that the direction values D',D'' and the pointing values h',h'' are only stored for the speech parameter values k following one another in one direction and that, after the formation of each direction value D'',D' for the speech parameter values k following one another in the other direction, the new sum value D and the total pointing value H are directly formed and stored. The required storage capacity can be reduced even further in this manner.

An arrangement for carrying out the method according to the invention is characterized by a first memory for the individual values d(k,i) of all speech parameter values k of at least in each case one point in time i, a second memory for in each case one sum value D(k,i) for each speech parameter value k of at least in each case one point in time i, a third memory for in each case one first direction value D'(k,i) and a pointing value h'(k,i) for each speech parameter value k of at least in each case one point in time i, a fourth memory for a second direction value D''(k,i) and an associated pointing value h''(k,i) of at least one speech parameter value k for the same point in time i as the values in the third memory, a fifth memory for the total pointing values H(k,i) for all speech parameter values k and all points in time i, a processing arrangement with inputs which are coupled to a data output of the first, the second, and the third or fourth memory, respectively, and with an output for emitting in each case one direction value D'(k,i),D''(k,i) and an associated pointing value h'(k,i),h''(k,i) which is coupled to the data input of the third memory (30), a comparator with two inputs, one of which receives from the data output of the third memory in each case one first direction value D'(k,i) and the other input receives the associated second direction value D'(k,i), and with an output which controls a change-over switch which supplies the smaller one of the two direction values to the data input of the second memory, and a control arrangement with an address generator which cyclically generates the addresses of all speech parameter values in the one direction of the address sequence and thereafter in the other direction of the address sequence for at least the first to third and the fifth memory and which, in addition, generates the address selection for the point in time at least for the fifth memory, and with a sequence control which controls the loading and reading out at least of the second, third and fifth memory. The method according to the invention can be implemented in this manner with relatively low expenditure.

Figure 2:
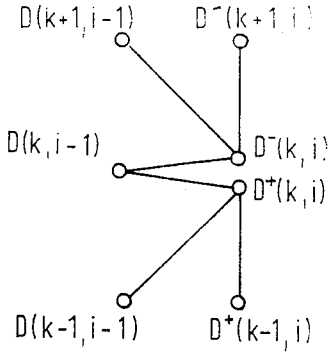
Figure 3:
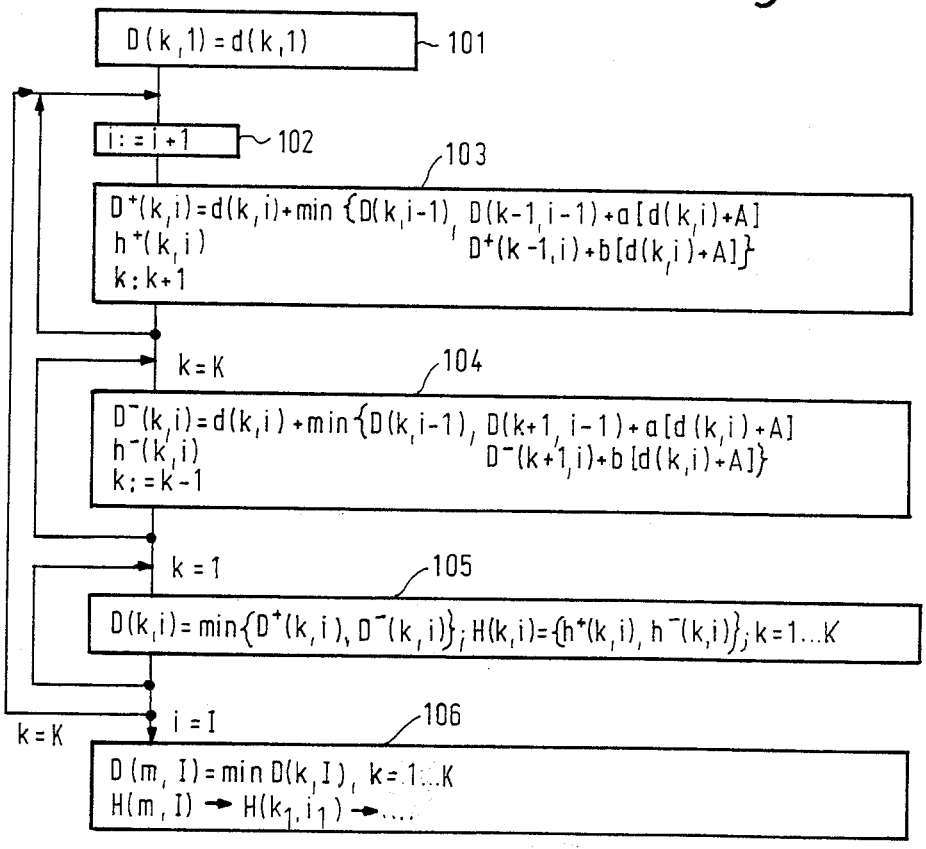
Figure 4:
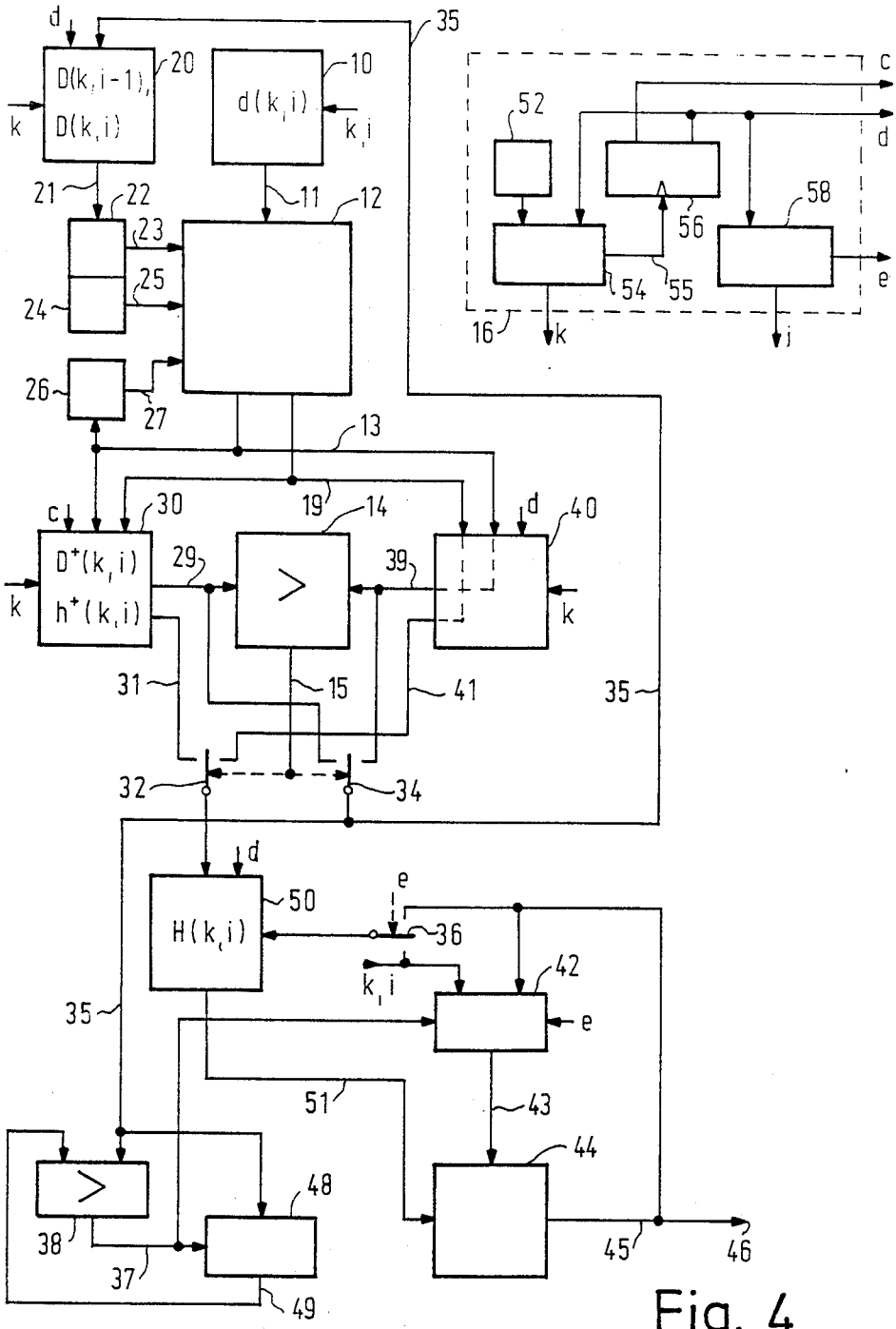
Figure 5:
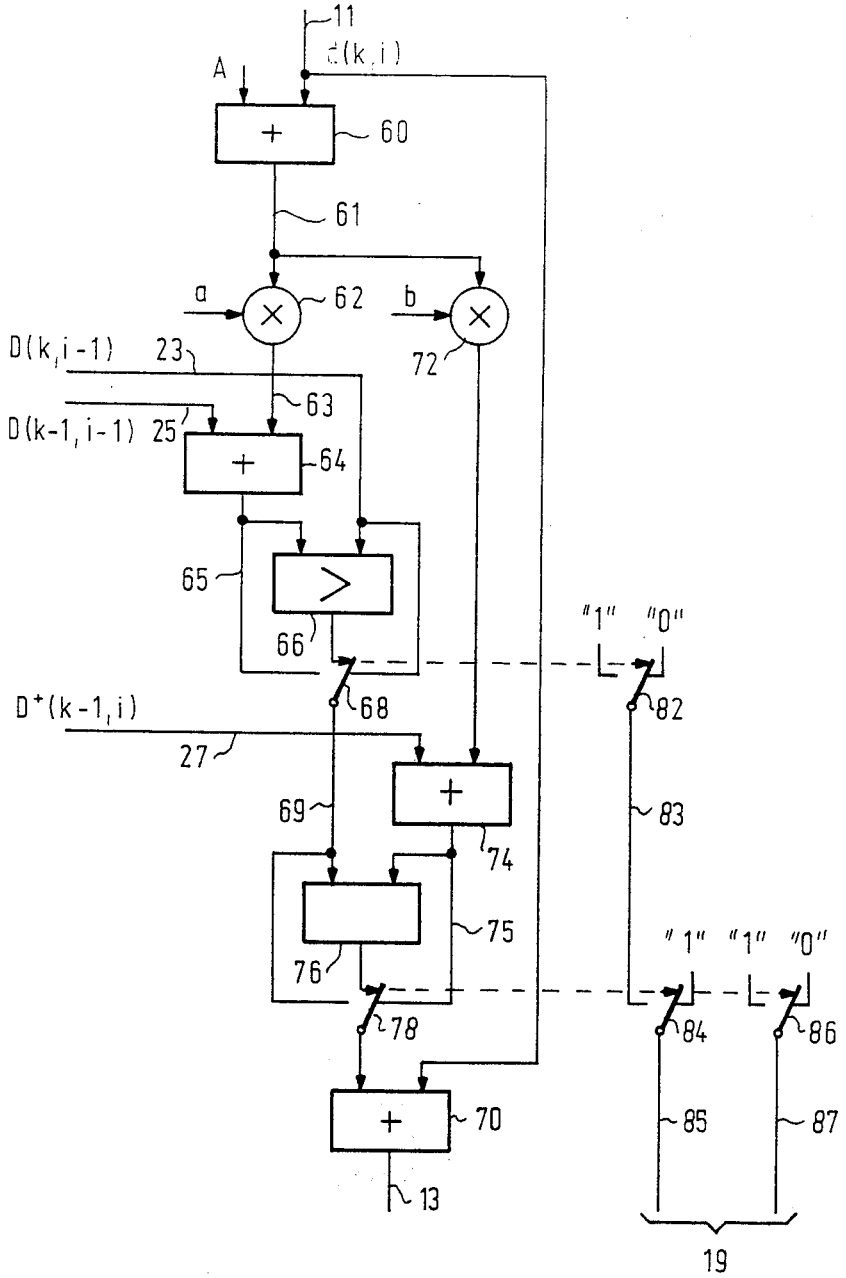

In the text which follows, illustrative embodiments of the invention are explained with the aid of the drawing in which:

FIG. 1 shows an example of a possible variation of a speech parameter over the successive points in time of a speech signal, FIG. 2 shows a diagram for explaining how the individual direction values are determined, FIG. 3 shows an arrangement for the sequence of the method according to the invention, FIG. 4 shows a circuit arrangement for carrying out the method according to the invention, and FIG. 5 shows a possible embodiment of the processing arrangement therein.

In FIG. 1, the variation of a speech parameter with time is diagrammatically shown in a two-dimensional representation. As an example, it is assumed that the speech parameter is the fundamental voice frequency. The speech parameter values k plotted against the ordinate and extending from 1 to K thus represent various discrete frequency values whereas the time is plotted in the form of discrete points in time i, extending from 1 to I at the end of the speech signal, along the abscissa. It is clear that, in practice, the number of values in both coordinate directions is actually significantly greater.

At any point in time i, an individual value d(k,i) exists for each speech parameter value k, that is to say for each point of intersection of the two coordinates, specified by a small circle. This value can be obtained, for example, by sampling the speech signal at a high rate, for example 10 kHz. A number of samples, for example 100 to 200, in each case produce a speech segment which thus has a duration of 10 to 20 msec. The samples of the speech signal are then designated by s(i,j), the index i specifying the speech segments and the index j specifying the samples in a speech segment. Using the AMDF (Average Magnitude Difference Function) then results in the individual values:

$$d(k,i): = \sum_j |s(i,j+k) - s(i,j)|$$

that is to say, the speech segment is shifted by a number k of samples with respect to the speech signal and the amounts of the differences between corresponding samples within the speech signal are summed together. Thus, each shift k corresponds to a particular frequency. In this manner, an individual value d(k,i) is produced for each value of k within a predetermined range of values corresponding to the fundamental speech frequencies occurring in practice. These individual values can then be considered as a type of probability or improbability that the frequency specified by the speech parameter value k is actually the fundamental frequency of the speech signal in this speech segment so that the individual value for the speech parameter value k corresponding to the actual fundamental frequency is a minimum.

In FIG. 1, particular points of intersection of the two coordinates k and i, corresponding in each case to an individual value, are connected to one another by a line in order to show an example of a possible variation of the fundamental voice frequency with time. The line links such a sequence of individual values so that the sum of these individual values connected in this manner results in a minimum compared with any other connection, this connection only being able to extend horizontally, diagonally or vertically. Although a vertical variation of the fundamental speech frequency cannot occur in practice, these are time-discrete values so that a rapid change of the fundamental speech frequency between two successive points in time i in the discrete model of FIG. 1 must be approximated by a vertical variation. The restriction that only a horizontal, diagonal or vertical variation is permitted, that is to say that the line only connects immediately adjacent individual values to one another, results in a smoother curve, but it can happen that the line does not exactly connect the minima of the individual values of each point in time i to one another but that a connection is formed which minimises the deviations from the minimum individual values, that is to say the errors. Freak values of individual values at individual points in time which are possible due to the complex form of the speech signal and due to other influences are eliminated during this process.

The determination of the variation resulting in the smallest total sum of the individual values at the end is explained in greater detail with the aid of FIG. 2. Since a vertical variation is possible both from the top down and from the bottom up, as can be seen from FIG. 1, the respective sum value of the individual values is determined separately for both directions and the process is continued with the smaller one of the resultant sum values which will be called direction values in the text which follows.

To be able to explain this more easily, a point k,i currently being processed, that is to say the speech parameter value k at time i, is shown twice in FIG. 2. The consequence is that the horizontal connection to the identical speech parameter value k of the preceding point in time i−1 extends slightly obliquely, for drawing reasons only.

Firstly, the direction value $D^+(k,i)$ is determined for the ascending direction, for which purpose the sum value or direction value formed for this direction from each of the three adjacent points is used and incremented by the individual value d(k,i) at the point concerned. Since a horizontal variation is more probable than an oblique variation or especially a vertical variation, the values D(k−1,i−1) of the diagonally adjacent point and $D^+(k-1,i)$ of the point vertically below are not directly used but incremented by a particular value as will be explained later in detail. The value $D^+(k-1,i)$ of the point vertically below must have been determined first and for this, in turn, the value of the point below must be determined, and so forth down to the bottom point so that the direction values $D^+(k,i)$ must be determined starting with k=1. This correspondingly also applies, however, to the direction value $D^-(k,i)$ for the downward direction for which the sum value D(k+1,i−1) of the point diagonally above and the direction value $D^-(k+1,i)$ of the point vertically above is needed, the latter having had to be determined first so that the process in this direction must be begun at the value k=K. The result is that it is logical first to determine and temporarily store all direction values of the one direction, for example the direction values $D^+$ and only then the direction values for the other direction, that is to say, in this case, the direction values $D^-$ and only then to determine the minimum of the two direction values as new sum value D. A possibility that only all direction values, for example $D^+$, of one direction need to be determined and temporarily stored will be explained later.

Thus, the direction values $D^+$ and the direction values $D^-$ of both directions are in each case determined for all speech parameter values for a point in time i and from this in each case the minimum is determined as new sum value D and stored in the manner explained with the aid of FIG. 2. At the last point in time I, the speech parameter value k, at which this sum value D is the smallest of all other sum values at this point in time, then specifies the end of the sequence. So that the variation of the sequence can be traced back, starting from this end, the preceding point starting from which this direction value or sum value has been achieved must be stored with each direction value and then with the sum value. This makes it possible, at the minimum sum value D at the last point in time I, to determine the point from which this value has been reached, that is to say the point which is the preceding point, and, from the value stored for this point, the point preceding this point can be determined, and so forth, finally resulting in the entire sequence of speech parameter values which has resulted in the minimum sum value D at the last point in time I. The values pointing to the direction in which the point is located, from which the following point has been reached in each case, are designated by pointing value or total pointing value and, naturally, must be stored for each speech parameter value k at each point in time i. However, since there are only five directions, only three bits are required for this. All other values only need to be stored, at the most, for all speech parameter values k of a point in time i or i−1, respectively.

Incidentally, each of the two direction values $D^+$ and $D^-$ contains the horizontal direction so that both direction values are equal when this direction produces the smallest direction value. Thus, the horizontal direction could be omitted for one direction value.

FIG. 3 diagrammatically shows the entire sequence of the individual processing steps for determining the variation of the speech parameter values with time. Block 101 designates the usual adjustments of initial states such as resetting of counters and clearing memory areas which are not separately specified. Only the filling of the storage locations for the sum values D(k,1) for the first point in time i=1 with the corresponding individual values d(k,1) is specified.

Following this, in block 102 a counter specifying the instantaneous point in time i is switched to the next point in time i+1. After that, the ascending direction values $D^+(k)$ are determined in block 103 in the following manner:

$$D^+(k,i)=d(k,i)+\min\{D(k,i-1),D(k-1,i-1)+a[d(k,i)+A],\ D^+(k-1,i)+b[d(k,i)+A]\} \quad (1)$$

According to FIG. 2, this equation means that the individual value d(k,i) is added to the minimum of the sum values of the three adjacent points, the sum value D(k,i−1) being directly used for the horizontal direction whereas in the case of the other values a term is added which depends on the individual value of the point just being considered and on fixed quantities a or b and A. The quantity A corresponds to the individual values in unvoiced speech signal segments and in pause segments and leads to the variation virtually always being horizontal in these zones. Quantities a and b influence the smoothness of the variation, that is to say, the greater a and b, the stronger the disadvantageous effect on the diagonal and the vertical direction. These are therefore quantities which have been empirically obtained and which are generally between 0.5 and 2.0 in the case of speech signals. In block 103, in addition, the pointing value $h^+(k,i)$ is determined which specifies the preceding point from which the current point has been reached, that is to say which of the three terms from which the minimum is determined in the case of direction value $D^+(k,i)$ has resulted in this minimum. In addition, a counter for the speech parameter value k is incremented by 1 to k+1.

Thus, block 103 is successively performed for all speech parameter values k of a particular point in time i.

When the direction value and the pointing value has been determined for all values k and temporarily stored, that is to say k=K, the other direction value $D^-(k,i)$ for the other direction is determined in accordance with block 104 in the following manner:

$$D^-(k,i)=d(k,i)+\min\{D(k,i-1),D(k+1,-1)+a[d(k,i)+A],\ D^-(k+1,i)+a[d(k,i+A]\} \quad (2)$$

The same applies to this equation as to the calculations of block 103 except that the points preceding in the other direction are taken into consideration, that is to say k−1 is replaced by k+1. The pointing value $h^-(k,1)$ is also determined in corresponding manner. Since these are the direction values for the downward pointing direction, the calculation beginning with the highest speech parameter value K, the counter for the speech parameters k is here decremented by 1 to k−1 in each case after the determination of the direction value and the associated pointing value.

When all direction values and pointing values of the other direction have also been determined, that is to say also for the first speech parameter value k=1, the minimum of the two direction values $D^+(k,i)$ and $D^-(k,i)$ of all speech parameters k is in each case determined according to block 105 and stored as sum value D(k,i) and, in addition, the associated pointing value $h^+(k,i)$ and $h^-(k,i)$ is in each case stored as total pointing value H(k,i). when this has been done for all speech parameter values k, that is to say k=K, the process returns to block 102 where the counter for the point in time i is set to the next value i+1 and the process described is repeated.

The processes separately specified in blocks 104 and 105 can also be performed jointly, that is to say after each determination of a direction value $D^-(k,i)$ for a speech parameter value k, it can be determined immediately thereafter whether this direction value $D^+(k,i)$ or the one determined in the preceding pass is smaller, and the smaller one of the two is stored as new sum value D(k,i). In this arrangement, however, the previous sum value D(k,i−1) must be temporarily stored since it is still needed for the direction value $D^-(k-1,i)$ following. In addition, a greater number of steps must then be performed for each speech parameter value k.

When the sum values D(k,i) and, particularly, the pointing values H(k,i) have been determined for all points in time i, that is to say the last point in time i=I has been reached, the processes according to block 106 are triggered. According to this, first the sum value D(m,I) is determined which represents the minimum of all sum values D(k,I) at the last point in time I. After that, the total pointing value H(m,I) belonging to this minimum sum value D(m,I) is read out and from this the point $k_1,i_1$ preceding the point m,I is determined. The pointing value $H(k_1,i_1)$ stored at this point is then read out and the point preceding this value, in turn, is determined and so forth until the start of the variation of the speech parameter determined in this manner is reached. The sequence of points produced during this tracing back in the form of their coordinates, that is to say the point in time i and the speech parameter k, represents the sequence sought.

FIG. 4 shows the block diagram of an arrangement which executes the processing steps specified in FIG. 3. Block 10 preferably designates a memory which contains all individual values d(k,i) and which is addressed by the speech parameter values k and the values corresponding to the points in time i. Block 10 must contain at least the individual values for all speech parameters k of a point in time i since these are needed twice in each case, namely for the two direction values $D^+$ and $D^-$. Block 10 can also include the arrangement for generating the individual values which, however, is not a part of the invention and is therefore not specified in greater detail.

Block 20 represents a memory which contains the sum values D(k,i−1) of the point in time i−1 preceding in each case at the beginning of a new point in time i and which contains the new sum values D(k,i) at the end of this new point in time. The generation and loading of these sum values will be explained later. The memory 20 is addressed by the speech parameter values k and it is switched to loading the values supplied via the connection 35, via an input which receives a signal d. The data output 21 of the memory 20 is connected to the series circuit of two registers 22 and 24, register 22 of which accepts the value from output 21 and, at the same time, transfers its previous content into the other register 24. Thus, the register 22 in each case contains the sum value D(k,i−1) and register 24 contains the preceding sum value D(k−1,i−1) or D(k+1,i−1), depending on the direction values which are being calculated at the time. Another register 26 is provided which accepts the direction value $D^+(k-1,i)$ or $D^-(k+1,i)$ which has just been determined and which is present on connection 13, and makes this value available at output 27 during the determination of the direction value following in each case.

The outputs 11 of the memory 10 and 23, 25 and 27 of the registers 22, 24 and 26 lead to a processing arrangement 12 which performs the calculations specified in blocks 103 and 104 in FIG. 3 and generates, as mentioned, the new direction value $D^+(k,i)$ or $D^-(k,i)$ in each case at output 13 and the associated pointing value $h^-(k,i)$ or $h^+(k,i)$ at output 19. These values are supplied to a memory 30 which is also addressed by the speech parameter values k and which, in a first pass at the beginning of each new point in time in which, for example, the one direction values $D^+(k,i)$ and the associated pointing values $h^+(k,i)$ for all speech parameter values k are generated, is switched to write by a signal c at an additional input and thus accepts all direction values and pointing values in this pass.

When all direction values and pointing values of one direction have been generated, the memories 10 and 20 are addressed in the reverse order of the speech parameters k, that is to say starting from the maximum value $k=K$ to the minimum value $k=1$ if the addressing has previously run starting from the minimum value to the maximum value. The direction values $D^-(k,i)$ generated during this second pass by the processing arrangement 12 on the connection 13 and pointing values $h^-(k,i)$ generated on the connection 19 are supplied to another memory 40 which is also addressed by the speech parameter values k and is set to write by a signal d at another input.

After both direction values and pointing values have been generated for all speech parameter values k of a point in time and these values have been loaded into memories 30 and 40, all speech parameter values k are again successively generated and the contents of these memories 30 and 40 are read out for each value k. The two direction values $D^+(k,i)$ and $D^-(k,i)$ are supplied via the lines 29 and 39 to a comparator 14 which, depending on which of the two direction values is smaller, outputs a corresponding signal at its output 15. If the direction value on connection 29 is smaller than the direction value on connection 39, the comparator 14 generates on line 15 a signal which switches the two change-over switches 32 and 34 into the left-hand position so that, therefore, the smaller one of the two direction values is supplied via the change-over switch 34 and the line 35 as new sum value to the memory 20 and is loaded into this memory and, at the same time, the associated pointing value output on the connection 31 is supplied as total pointing value via switch 32 to a memory 50 and is there stored. The memory address for the memory 50 is supplied via the change-over switch 36 which is first held in its lower position by a signal e so that the address is formed from the speech parameter value k and the value i for the respective point in time.

If the direction value on the connection 39 is smaller than the direction value on the connection 29, the comparator 14 generates at output 15 a signal which switches the two change-over switches 32 and 34 into the opposite position so that the smaller direction value is then again supplied via the connection 35 to the memory 20 and the associated total pointing value output on the connection 41 is supplied to the memory 50 via the change-over switch 32. In the memory 20, the minimum direction values supplied on the connection 35, which represent the new sum value $D(k,i)$, overwrite the corresponding previously stored sum values of the same speech parameter value k so that the memory 20 only needs to have a capacity of K words. This correspondingly also applies in the memories 30 and 40. It is only the memory 50 which must have a storage location for a total pointing value, which only needs to be three bits long because of the fact that only five different directions are possible, for each speech parameter value k of each point in time i.

When the last speech segment has been processed in this manner and the point in time I has thus been reached, an arrangement of a comparator 38 and a register 48 is switched into circuit by means of which the minimum sum value $D(m,I)$ at this last point in time I and the associated speech parameter $k=m$ of this minimum is determined. For this purpose, for example, the content of register 48 is held at its maximum value and released only with the last point in time I which is not shown in greater detail for the sake of clarity.

The first sum value $D(k,I)$ which appears on connection 35 at the point in time I at the output of the change-over switch 34 is supplied to one input of the comparator 38 and to the data input of the register 48 the output 49 of which is connected to the other input of the comparator 38. Since the sum value occurring on the connection 35 will be smaller than the maximum value at which the register 38 has been previously held and which is still present on the connection 49, the comparator 38 generates on its output line 37 a signal which loads the current sum value on the connection 35 into the register 48 and, in addition, the current speech parameter value k and the value I of the current point in time is loaded into another register 42. If the next sum value occurring at the output of switch 34 is smaller than the preceding value, the comparator 38 again generates a signal on the output line 37 so that this smaller sum value is loaded into the register 48 and the corresponding values k and I are loaded into the register 42. This occurs until the sum value appearing at the output of switch 34 is no longer smaller than the preceding sum value so that the register 48 always contains the smallest sum value and the register 42 the associated values k and i. This is continued until the last sum value at time I so that the memory 50 then contains all total pointing values $H(k,i)$ and the register 48 contains the smallest of all sum values at time I and the register 42 contains the corresponding values k and I. This identifies the end of the sequence sought.

Now, the change-over switch 36 is switched over by the signal e so that the memory 50 is addressed by the output 45 of an address calculator 44. This receives, from register 42 via connection 43, the values m and I corresponding to the minimum sum value contained in that register, and the total pointing value $H(m,I)$ contained at this address in memory 50 is read out and supplied via the connection 51 to the address calculator 44. This uses this pointing value to modify the values supplied via the connection 43 so that the values $k_1$ and $i_1$ of the preceding point appear at the output 45. These values are loaded into the register 42 and, at the same time, address the memory 50 so that the associated pointing value $H(k_1,i_1)$ is read out and supplied via the connection 51 to the address calculator 44. This calculator again uses this value to generate the values of the next preceding point on the connection 45 which are again stored in register 42 and, at the same time, address the memory 50 and so forth so that, finally, the sequence of the values k and i sought appears in the reverse order at the output 46. These can be temporarily stored or also directly processed, which is not shown in greater detail since it is no longer part of the invention.

It is also possible to save the memory 40, in which arrangement the connection 13 is then directly coupled to the connection 39 and the connection 19 is directly coupled to the connection 41 in accordance with the explanation at FIG. 3 when the blocks 104 and 105 are combined. Thus, when the direction values for one direction, for example the direction values $D^+(k,i)$ and the associated pointing values $h^+(k,i)$ for all speech parameter values k have been generated and are stored in the memory 30, each direction value $D^-(k,i)$ generated by the processing arrangement 12 on the connection 13 is then directly supplied to the comparator 14 which then, at the same time, receives the other direction value $D^+(k,i)$ from the memory 30 via the connection 29, and the smaller one of these two direction values is then directly supplied via the change-over switch 34 and the connection 35 to the memory 20 and loaded into it. At the same time, the associated pointing value is loaded as total pointing value H(k,i) into the memory 50 via the switch 32. In this arrangement, only two passes of all speech parameter values k are then required for each point in time i.

A control arrangement which generates the values k and i required for this and the control signals c, d and e is shown in the dashed block 16. This contains a clock generator 52 which drives a counter 54 each possible position of which represents a different value of the speech parameter k. This counter 54 is assumed to start counting at 1 and, when it has reached the last speech parameter value k=K, it emits on line 55 a signal which switches over a bistable flip flop stage 56 so that the signal c disappears which has controlled the loading into the memory 30 and the signal d begins by means of which the sum values D(k,i) are loaded into the memory 20 and the total pointing values H(k,i) are loaded into the memory 50. At the same time, the direction of counting of the counter 54 is reversed which now counts down again so that the values k at its output run from K to 1. This is the second pass during which the other direction values and the new sum values and the total pointing values are generated and stored.

When the counter 54 has returned to its initial position, a signal is generated again on line 55 so that the bistable flip flop stage 56 switches over again and the signal d disappears and the signal c begins again and, at the same time, a counter 58 is stepped on by one position the outputs of which supply the values i.

When the counter 58 has finally passed through all positions in this manner and has reached the last point in time I, it subsequently generates, for example at a carry output, the signal e which switches over the change-over switch 36, as has been described above, so that the tracing back of the sequence determined can begin.

The clock control system which may be required for the memories 20, 30 and so forth and for the registers 22, 24 and so forth and the processing arrangement 12 and which has not been shown in FIG. 4 for the sake of clarity can also be derived from the clock generator 52.

FIG. 5 shows a possible embodiment of the processing arrangement 12 in FIG. 4. The individual value d(k,i) supplied via the connection 11 is supplied to one input of an adder 60 the other input of which receives the constant value A which, for example, is predetermined by hard wiring. The sum formed in this adder and appearing on connection 61 is supplied to a multiplier 62 where this sum is multiplied by the fixed value a. Since the exact value of the quantity a is not very critical, it can be formed from a small number of individual summands which in each case are an integral negative power of 2, so that the multiplier 62 can be constructed from a small number of cascaded adders.

The product created on the connection 63 is supplied to an adder 64 where it is added to the value on the connection 25 of the register 24 and this is the sum value D(k−1,i−1) when the speech parameter values k follow each other in ascending order.

The value formed in the adder 64 and supplied on the connection 65 is supplied to one input of a comparator 66 where it is compared with the value supplied via the connection 23 from register 22, that is to say with the sum value D(k,i−1). The comparator 66 controls, in dependence on the result of the comparison, a change-over switch 68 which supplies the smaller value supplied to the comparator 66 via the connection 69 to one input of another comparator 76.

The other input of the comparator 76 is connected to the output connection 75 of another adder 74 which ads the value supplied on the connection 27 from register 26 to the sum, multiplied by the quantity b in the multiplier 72, on the connection 61. The comparator 76, in turn, controls a change-over switch 78 in such a manner that the smaller one of the values supplied to the comparator 76 is forwarded and supplied to one input of another adder 70 which receives at its other input the individual value d(k,i) supplied via the connection 11. The sum created at the output 13 of the adder 70 is the direction value $D^+(k,i)$. The direction values $D^-(k,i)$ for the opposite direction are created in corresponding manner at the output 13 when the speech parameters k run from large values towards small values.

In parallel with the change-over switch 68, the output signal of the comparator 66 actuates a change-over switch 82 which supplies either the logical value "0" or "1" to a line 83, the latter value meaning that the preceding point is at least obliquely below, that is to say one unit must be subtracted at the speech parameter k in the address calculator 44 in FIG. 1 for addressing the next value.

Line 83 forms one connection of another change-over switch 84 which is controlled by the output signal of the comparator 76, in parallel with the change-over switch 78, and the other input of which permanently receives the logical value "1". In parallel to this, another change-over switch 86 is controlled which permanently supplies the logical value "1" to the output line 87 in the left-hand position and the logical value "0" in the right-hand position, the latter value specifying that the preceding point belongs to the same point in time, that is to say is located vertically below so that the address calculator 44 in FIG. 1, in this case, supplies the same address section i for addressing the memory 50 as i the case of the preceding address in each case. The two output lines 85 and 87 of the change-over switches 84 and 86, together, form the connection 19 which leads to the memories 30 and 40 and the change-over switch 32, respectively, in FIG. 4. This change-over switch can specify, for example via a third bit the value of which is switched, whether the preceding point is above or below the point just being considered and whether a unit must then be added to the current value k or a unit must be subtracted from it in the address calculator 44.

The arrangement shown in FIGS. 4 and 5 is only to be considered by way of example and, in particular, some sections or even all sections can be implemented by a microprocessor programmed in appropriate manner.

What is claimed is:

1. Method for determining the variation with time of a speech parameter of a speech signal, in which an individual value exists at discrete points in time for each value of a predetermined value range of the speech parameter and the variation with time represents the sequence of adjacent, including diagonally adjacent, speech signal parameter values the individual values of which are at least close to the extreme values of the individual values for the individual points in time, the sum of the individual values of this sequence forming an extreme value sum compared with other sequences, characterized in that, referred to the minimum as extreme value of the individual values and as extreme value sum at each point in time (i), a first direction value D'(k,i) is formed in a first step successively for all speech parameter values (k) following one another in the one direction, as the sum of the individual value concerned d(k,i) and the minimum of the following values D(k,i−1)

D(l,i−1)+a(d(k,i)+A)

D'(l,i)+b(d(k,i)+A)

as well as a pointing value h'(k,i) pointing to the individual value supplying the minimum and is stored, where D(k,i−1) and D(l,i−1) is a sum value generated and stored at the respectively preceding point in time i−1 and the same speech parameter value k or the preceding speech parameter value l, respectively, D(l,i) is the direction value formed at the immediately preceding speech parameter value l and a, b, A are predetermined fixed quantities, that thereafter a second direction value D''(k,i) with a pointing value h''(k,i) is formed, in the manner corresponding to the first step, in a second step for the same point in time i for all speech parameter values k following one another in the other direction, that for each speech parameter value k the minimum of the two direction values D',D'' and the pointing value h',h'' belonging to this direction value is stored as in each case the new and as total pointing value H, respectively, and that the immediately preceding speech parameter value is determined, at the latest at the end of the speech signal, from the total pointing value H(k,I) which belongs to the speech parameter value k with the extreme value sum at the last point in time I and the associated total pointing value is read out and so forth, the sequence of speech parameter values produced during this process being output and stored.

2. Method according to claim 1, characterized in that the direction values D',D'', the pointing values h',h'' and the new sum values D are stored for only one point in time i in each case and thereafter are overwritten again.

3. Method according to claim 2, characterized in that the direction values D',D'' and the pointing values h',h'' are only stored for the speech parameter values k following one another in one direction and that, after each direction value D'',D' has been formed for the speech parameter values k following one another in the other direction, the new sum value D and the total pointing value H is directly formed and stored.

4. Arrangement for carrying out the method according to one of claims 1 to 3, characterized by a first memory (10) for the individual values d(k,i) of all speech parameter values k of at least in each case one point in time i, a second memory (20) for in each case one sum value D(k,i) for each speech parameter value k of at least in each case one point in time i, a third memory (30) for in each case one first direction value D'(k,i) and a pointing value h'(k,i) for each speech parameter value k of at least in each case one point in time i, a fourth memory (26; 40) for a second direction value D''(k,i) and an associated pointing value h''(k,i) of at least one speech parameter value k for the same point in time i as the values in the third memory (30), a fifth memory (50) for the total pointing values H(k,i) for all speech parameter values k and all points in time i, a processing arrangement (12) with inputs which are coupled to a data output of the first, the second, and the third or fourth memory (10, 20, 30, 26, 40), respectively, and with an output for emitting in each case one direction value D'(k,i), D''(k,i) and an associated pointing value h'(k,i), h''(k,i), which is coupled to the data input of the third memory (30), a comparator (14) with two inputs, one of which receives from the data output of the third memory (30) in each case one first direction value D'(k,i) and the other input receives the associated second direction value D'(k,i), and with an output which controls a change-over switch (32) which supplies the smaller one of the two direction values to the data input of the second memory (20), and a control arrangement (16) with an address generator (54, 58) which cyclically generates the addresses of all speech parameter values k in the one direction of the address sequence and thereafter in the other direction of the address sequence for at least the first to third and the fifth memory (10, 20, 30, 50) and which, in addition, generates the address selection for the point in time i at least for the fifth memory (50), and with a sequence control (56) which controls the loading and reading-out of at least the second, third and fifth memory (20, 30, 50).

* * * * *